US012703834B1

(12) United States Patent
Haris et al.

(10) Patent No.: US 12,703,834 B1
(45) Date of Patent: Aug. 11, 2026

(54) ANTI-STICTION IONIC LUBRICANTS IN MEMS DEVICES

(71) Applicant: TEXAS INSTRUMENTS INCORPORATED, Dallas, TX (US)

(72) Inventors: Uroob Haris, Sachse, TX (US); John Faruk Alptekin, Carrollton, TX (US); Muralidhar Hanabe, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 18/680,435

(22) Filed: May 31, 2024

(51) Int. Cl.

| | |
|---|---|
| ***C10M 105/70*** | (2006.01) |
| ***C10M 105/74*** | (2006.01) |
| ***C10M 177/00*** | (2006.01) |
| *C10N 20/00* | (2006.01) |
| *C10N 40/14* | (2006.01) |

(52) U.S. Cl.
CPC ..... *C10M 105/70* (2013.01); *C10M 105/74* (2013.01); *C10M 177/00* (2013.01); *C10M 2215/221* (2013.01); *C10M 2215/2245* (2013.01); *C10M 2223/0603* (2013.01); *C10N 2020/077* (2020.05); *C10N 2040/14* (2013.01)

(58) Field of Classification Search
CPC ..... C10N 2020/077; C10N 2040/14; C10M 105/70; C10M 105/74; C10M 177/00; C10M 2215/221; C10M 2215/2245; C10M 2223/0603
See application file for complete search history.

(56) References Cited

U.S. PATENT DOCUMENTS

| | | | | |
|---|---|---|---|---|
| 5,602,671 | A | 2/1997 | Hornbeck | |
| 7,286,278 | B2 | 10/2007 | Patel et al. | |
| 8,803,296 | B2 | 8/2014 | Morrison et al. | |
| 2016/0124302 | A1* | 5/2016 | Oden | B81B 3/0045 430/270.1 |
| 2021/0301216 | A1* | 9/2021 | Li | G11B 5/7266 |

OTHER PUBLICATIONS

Bermudez et al., Ionic Liquids as Advanced Lubricant Fluids; Molecules (Aug. 4, 2009), pp. 2888-2908. (Year: 2009).*
Donato et al., "New Protic Ionic Liquids as Potential Additives to Lubricate Si-Based MEMS/NEMS," Molecules 2023, 28, 2678, 16 p.
Somers et al., "A Review of Ionic Liquid Lubricants," Lubricants 2013, 1, 3-21, 19 p.
Vekris et al., Cover Picture: Visualization of Stacking Faults and their Formation in Colloidal Photonic Crystal Films (Adv. Mater. Jun. 2008), Advanced Materials / vol. 20, Issue 6, 3 p.
International Search Report and Written Opinion in corresponding PCT Application PCT/US2025/031373, issued Oct. 6, 2025, 10 pgs.
Josekutty J Nainaparampil et al: "Ionic-Liquid Lubrication of Sliding MEMS Contacts: Comparison of AFM Liquid Cell and Device-Level Tests", Journal of Microelectromechanical Systems, IEEE Service Center, US, vol. 16, No. 4, Aug. 1, 2007 (Aug. 1, 2007) , pp. 836-843.

(Continued)

*Primary Examiner* — Ishal V Vasisth
(74) *Attorney, Agent, or Firm* — Michael T. Gabrik; Frank D. Cimino

(57) ABSTRACT

In examples, a microelectromechanical device comprises a moveable element configured to contact a portion of a surface, and an ionic liquid on the portion of the surface.

19 Claims, 8 Drawing Sheets

(56) References Cited

OTHER PUBLICATIONS

Manuel Palacio et al.: "A Review of Ionic Liquids for Green Molecular Lubrication in Nanotechnology", Tribology Letters, Kluwer Academic Publishers-Plenum Publishers, NE, vol. 40, No. 2, Jul. 27, 2010 (Jul. 27, 2010), pp. 247-268.
Zhao W et al: "Effect of anion on micro/nano-tribological properties of ultra-thin imidazolium ionic liquid films on silicon wafer", Colloids and Surfaces A : Physiochemical and Engineerings Aspects, Elsevier, Amsterdam, NL, vol. 332, No. 2-3, Jan. 15, 2009 (Jan. 15, 2009), pp. 78-83.

* cited by examiner

ANTI-STICTION IONIC LUBRICANTS IN MEMS DEVICES

BACKGROUND

Microelectromechanical systems (MEMS) devices are micron-scale electromechanical structures made using specialized semiconductor manufacturing techniques. MEMS devices integrate mechanical and electrical components on a single chip, enabling sensors, actuators, and other devices with high precision.

SUMMARY

In examples, a microelectromechanical device includes a moveable element configured to contact a portion of a surface, and an ionic liquid on the portion of the surface.

In examples, a method includes providing a microelectromechanical systems (MEMS) device including one or more surfaces, and contacting the one or more surfaces of the MEMS device with a lubricant under conditions suitable for formation of a film on at least a portion of the one or more surfaces of the device, the lubricant configured to reduce stiction on the one or more surfaces. The lubricant is an ionic liquid comprising a cation characterized by a general formula YRn, where Y is an onium ion and R is a substituted alkyl group, an unsubstituted alkyl group or a combination thereof and n ranges from 1 to 6, and the ionic liquid comprises an anion characterized by a general formula QZn, where Q is phosphorus, sulfur, or boron and Z is a halide, oxygen, alkoxy group, haloalkyl or combination thereof and n ranges from 1 to 6. The method includes activating the lubricant by heating the lubricant to a temperature between about 25° C. to about 200° C.

DETAILED DESCRIPTION

Figure 1A:
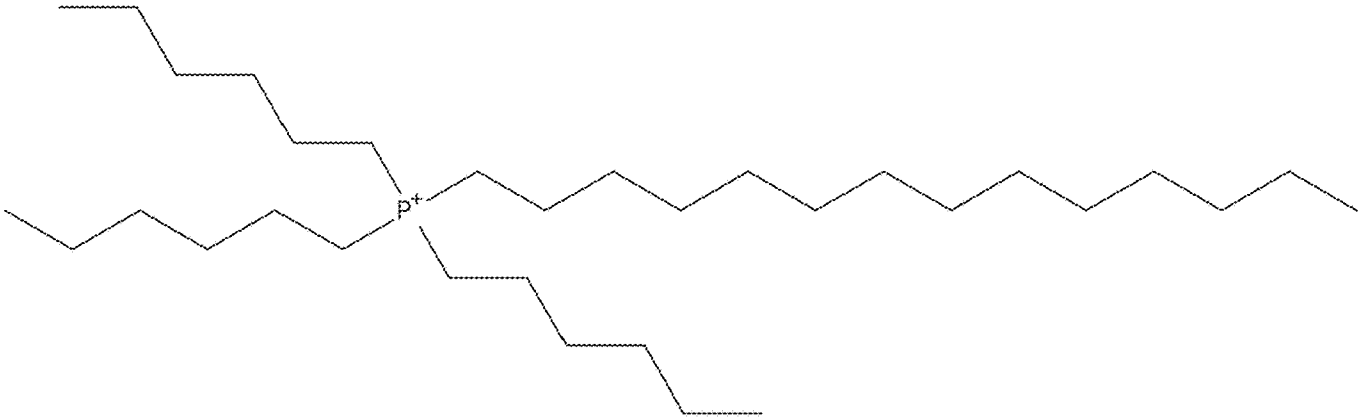
FIGS. 1A-1D are schematic diagrams representing chemical structures of ionic portions of ionic liquids suitable for lubricating MEMS devices to mitigate stiction, in accordance with various examples.
Figure 1B:
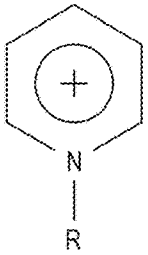
Figure 1D:
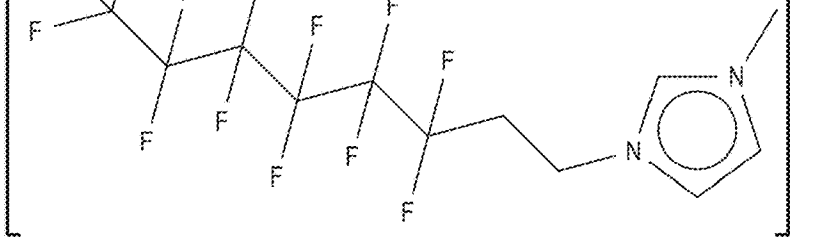
Figure 1C:
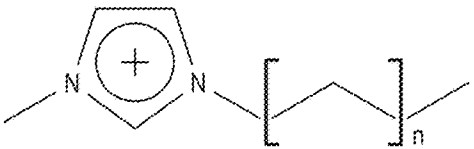
Figure 2B:
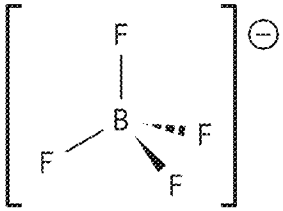
FIGS. 2A-2D are schematic diagrams representing chemical structures of ionic portions of ionic liquids suitable for lubricating MEMS devices to mitigate stiction, in accordance with various examples.
Figure 2D:
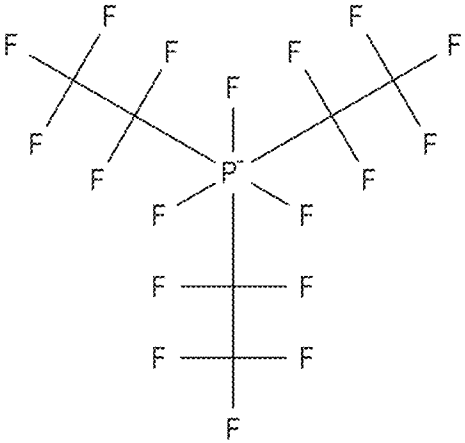
Figure 2A:
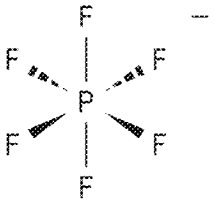
Figure 2C:
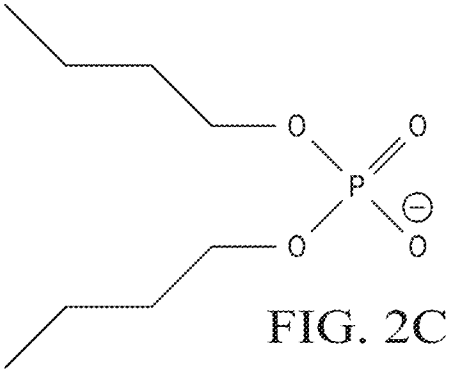

As described above, microelectromechanical systems (MEMS) devices integrate mechanical and electrical components on a single chip. The mechanical components, which may number in the dozens, hundreds, or thousands, are configured to engage in small movements that enable the function of the MEMS device. For example, one type of MEMS device, known as a digital micromirror device (DMD), may include an array of micron-scale mirrors that tilt in different directions to control the propagation of light. MEMS components, such as these small mirrors, can be susceptible to stiction, which is the adhesion or sticking of moving parts within a MEMS device, typically due to surface forces such as van der Waals or electrostatic forces. For example, in DMDs, stiction can cause the mirrors to become stuck in one position. Similarly, in MEMS accelerometers, a movable proof mass moves with reference to a fixed electrode, with the movement indicating the degree of acceleration. The proof mass may experience stiction vis-à-vis the fixed electrode, especially at lower spring constants that result in greater accelerometer sensitivity. This stiction can significantly impact the accuracy of acceleration measurements. Likewise, in microcantilevered atomic force microscopes (AFMs), the microcantilevers, which are useful for high-resolution surface imaging, experience stiction due to van der Waals forces or capillary forces, especially in humid environments. This stiction can significantly impact AFM device accuracy. In addition, in microvalves of MEMS fluidic devices, which are useful to control fluid flow in MEMS-based fluidic systems (e.g., lab-on-a-chip devices), stiction can occur due to surface tension of the liquid, electrostatic forces, or contamination. This stiction can prevent the valve from opening and closing properly, leading to malfunction of the system.

Stiction can cause impaired MEMS device functionality, mechanical wear and tear, deformation of moving parts, and irreversible adhesion between surfaces. In some applications, such as optical devices (e.g., projectors), stiction can result in diminished or unacceptable image quality. In critical applications such as automobiles, aerospace, and medical devices, where reliability and precision are particularly important, stiction-induced failures can have serious consequences, up to and including the loss of human life.

This disclosure describes various examples of MEMS devices coated with films including ionic liquids. The ionic liquid operates as a lubricant to mitigate stiction among moving components in the MEMS device, thereby reducing the likelihood that the MEMS device will experience the structural and functional degradation described above. In addition to mitigating stiction, the ionic liquids may shield the MEMS devices from water, reduce corrosion, and reduce residue and residue buildup. In some examples, a MEMS device includes a moveable element configured to contact a portion of a surface and an ionic liquid on the portion of the surface. Various chemical compositions of the ionic liquids are now described with reference to the drawings.

In one or more examples, a lubricant of the present disclosure includes an ionic liquid. As used herein, an ionic liquid refers to an organic salt consisting of an organic cation paired with an organic or inorganic anion that is in the liquid state at temperatures less than about 100° C.

In one or more examples, the ionic liquid includes an organic cation characterized by the general formula $YR_n$, where Y is an onium ion; R is an alkyl group; and n ranges from 1 to 6. As used herein, an onium ion refers to a cation formally obtained by protonation of the mononuclear parent hydride of a pictogen, a chalcogen, or a halogen which are members of group 15, 16, and 17 of the periodic table, respectively.

Nonlimiting examples of onium ions suitable for use in the present disclosure include boronium, carbonium, ethanium, propanium, propylium, butanium, silanium ammonium, phosphonium, oxonium, pyridinium, pyrimidinium, picolinium, sulfonium, hydroxylammonium, methylammonium, tetraphenylphosphonium, imidazolium, and guanidinium. In some examples, the onium ion is an imidazolium ion, a phosphonium ion, a piperidinium ion, a morpholinium ion, an ammonium ion, a pyrrolidinium ion, or a combination thereof.

In one or more examples, R is a substituted alkyl group, an unsubstituted alkyl group or a combination thereof. The term "alkyl group" is used herein in accordance with the definition specified by the International Union of Pure and Applied Chemistry (IUPAC): a univalent group formed by removing a hydrogen atom from an alkane. Primary, secondary, and tertiary alkyl groups are derived by removal of a hydrogen atom from a primary, secondary, tertiary carbon atom, respectively, of an alkane. The n-alkyl group may be derived by removal of a hydrogen atom from a terminal carbon atom of a linear alkane. The groups $RCH_2(R\neq H)$, $R_2CH(R\neq H)$, and $R_3C(R\neq H)$ are primary, secondary, and tertiary alkyl groups, respectively. When describing a group as being "derived by," "derived from," "formed by," or "formed from," such terms are used in a formal sense and are not intended to reflect any specific synthetic methods or procedure, unless specified otherwise or the context requires otherwise.

In one or more examples, R can be a $C_1$ to $C_{20}$ alkyl group or alternatively a $C_1$ to $C_{15}$ alkyl group. In one or more examples, R can be a methyl group, an ethyl group, an n-propyl group, an iso-propyl group, an n-butyl group, an iso-butyl group, a sec-butyl group, a tert-butyl group, an n-pentyl group, an iso-pentyl group, a sec-pentyl group, a neopentyl group, a hexyl group, a heptyl group, an octyl group, a nonyl group, a decyl group, a undecyl group, a dodecyl group, a tridecyl group, a tetradecyl group, a pentadecyl group, a hexadecyl group, a heptadecyl group, an octadecyl group, or a nonadecyl group. In examples where n is greater than one, each R may be the same alkyl group or, alternatively, each R is a different alkyl group. In an example, the organic cation includes any moiety having any of the structures shown in FIGS. 1A-1D.

In one or more examples, the ionic liquid includes an anion. Anions that may be paired with cations of this disclosure may be characterized by the general formula $QZ_n$, where Q is phosphorus, sulfur, or boron; Z is a halide, oxygen, an alkoxy group, a haloalkyl group or a combination thereof; and n ranges from 1 to 6. Nonlimiting examples of Z groups include chloride, bromide, iodide, fluoride, a bromomethyl group, an iodomethyl group, chloromethyl group, a fluoromethyl group, a bromoethyl group, an iodoethyl group, a chloroethyl group, a fluoroethyl group, a bromopropyl group, an iodopropyl group, a chloropropyl group, a fluoropropyl group, a bromobutyl group, an iodobutyl group, a chlorobutyl group, a fluorobutyl group, a bromohexyl group, an iodohexyl group, a chlorohexyl group, a fluorohexyl group, triflate, a polyhalogenated alkyl group, a methoxy group, an ethoxy group, a propoxy group, methyl sulfate, mesylate and combinations thereof.

In examples where n in $QZ_n$ is greater than 1, each substituent may be the same or, alternatively, each substituent is different. In one or more examples, the anion includes tetrafluoroborate, hexafluorophosphate, phosphate, perfluoroalkyl phosphate, bis(trifluoromethanesulfonyl)amide, or a combination thereof. In an example, the anion includes any compound having any of the structures shown in FIGS. 2A-2D.

Nonlimiting examples of ionic liquids suitable for use in the present disclosure include imidazolium hexafluorophosphate, perfluoroalkylphosphate, 1-butyl-3-methylimidazolium hexafluorophosphate, 1-methyl-3-octylimidazolium tetrafluoroborate, 1-(4-sulfobutyl)-3-hydrogen sulfate, methylimidazolium 1-(4-sulfobutyl)-3-methylimidazolium bis(trifluoromethanesulfonyl)imide, 1-(4-sulfobutyl)-3-methylimidazolium trifluoromethanesulfonate, 1-methyl-1-(2-methoxyethyl) pyrrolidinium bis(fluorosulfonyl)imide, 1-butyl-3-methylimidazolium iodide, N-butyl-N-methylpyrrolidinium bis(oxalato) borate, 1-(cyanomethyl)-3-methylimidazolium chloride, 1-ethyl-2,3-dimethylimidazolium chloride and 1-decyl-3-methylimidazolium chloride.

In some examples, the organic cation, anion or both excludes the use of halogen-containing chemical groups such as fluoride-containing substituents.

Ionic liquids are characterized by weak intermolecular forces that result in a reduced volatility as evidenced by the high boiling points and low vapor pressure. An ionic liquid's low volatility effectively eliminates a major pathway for environmental release and contamination. In one or more examples, an ionic liquid suitable for use in the present disclosure is characterized by a low volatility with a boiling point ranging from about 200° C. to about 600° C., alternatively from about 200° C. to about 550° C. or, alternatively, from about 200° C. to about 500° C.

In one or more examples, an ionic liquid suitable for use in the present disclosure is characterized by a vapor pressure ranging from about $1\times10^{-12}$ torr to about $1\times10^{-2}$ torr, alternatively from about $1\times10^{-10}$ torr to about $1\times10^{-2}$ torr or, alternatively, from about $1\times10^{-10}$ torr to about $1\times10^{-6}$ torr.

In one or more examples, an ionic liquid of the type disclosed herein is used in the absence of any other additives (e.g., surfactants, emulsifiers, solvents) as a lubricant to be applied to a surface. In an example, the ionic liquid is mixed with a base fluid that facilitates one or more user and/or process goals. For example, the base fluid may be chosen to provide features such as a desired rheology or to adjust concentration. In one or more examples, the base fluid includes hydrocarbons and hydrocarbon oils including but not limited to n-decane, n-hexadecane, and polyalphaolefin oils.

In one or more examples, the ionic liquid is prepared to provide a final amount of ionic liquid on the surface to which it is applied from about $1\times10^{-2}$ mg/cm$^2$ to about $1\times10^{-1}$ mg/cm$^2$, alternatively from about $2.5\times10^{-2}$ mg/cm$^2$ to about $1\times10^{-1}$ mg/cm$^2$ or, alternatively, from about $5\times10^{-2}$ mg/cm$^2$ to about $1\times10^{-1}$ mg/cm$^2$ based on the total area of the surface.

In one or more examples, a movable component of a MEMS device is in contact with one or more surfaces. The movable component may be in contact with the one or more surfaces continuously. In other examples, the movable component is in contact with the one or more surfaces intermittently.

In an example, an ionic liquid of the type disclosed herein is in contact with at least a portion of the one or more surfaces. Any suitable technique may be useful to contact the one or more surfaces with the ionic liquid. As described below, non-limiting examples of methods for contacting the one or more surfaces with the ionic liquid include deposition, chemical vapor deposition, dip coating, aerosol coating, spray coating, or a combination thereof. Contacting of the ionic liquid with at least a portion of the one or more surfaces is performed under conditions suitable for the formation of at least one layer (film) of the ionic liquid on the one or more surfaces. In an example, the surface includes a metal, a metal oxide or combinations thereof. For example, the surface includes one or more of aluminum, aluminum oxides, aluminum alloys, titanium, copper, steel, silicon or combinations thereof. In one or more examples, a surface for use in the present disclosure is characterized by the presence of reactive hydroxy groups (—OH) able to associate with one or more atoms in the ionic liquid. In one or more aspects, at least a portion of one or more surfaces of a device (e.g., DMD) includes hydroxyl groups or hydroxyl precursor groups. In an example, the anionic portion of the ionic liquid associates with cations (e.g., metal cations) on the one or more surfaces.

Figure 3:
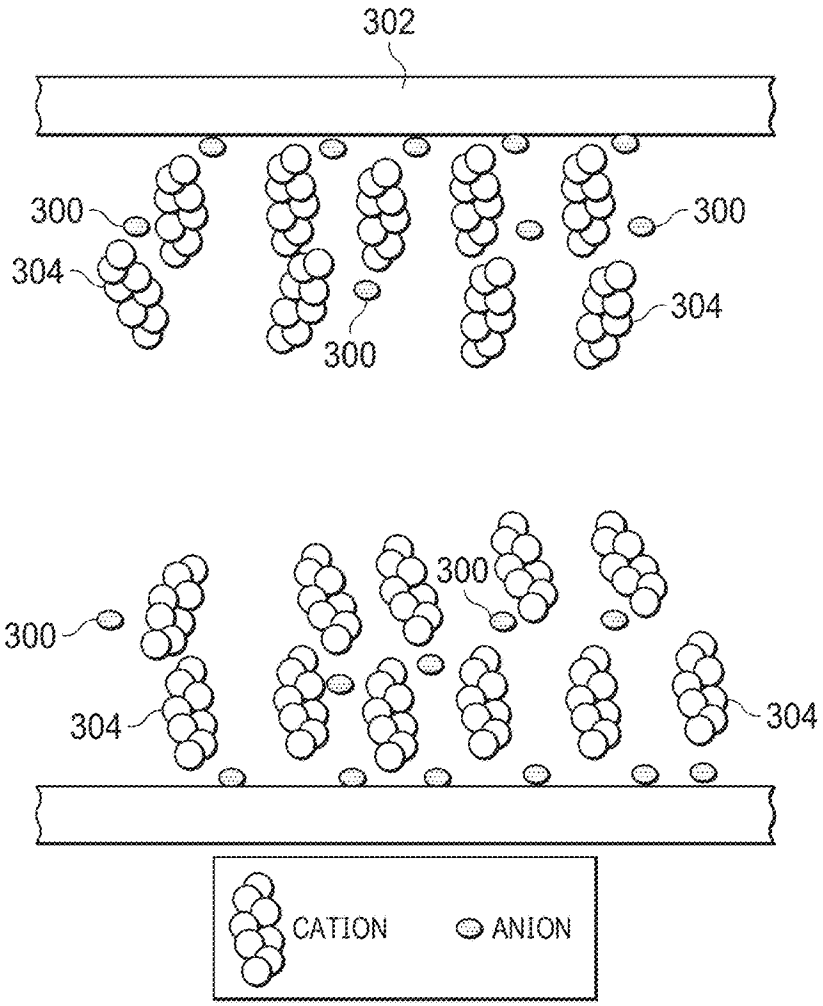
FIG. 3 is a schematic diagram of a film formed by applying an ionic liquid to a MEMS device surface susceptible to stiction, in accordance with various examples.

FIG. 3 is a schematic depiction of ionic liquid anions 300 adsorbing onto a positively charged metal surface 302 and the subsequent ordering of the ionic liquid. The charged metal surface may include a metal, a metalloid or combinations thereof. Specifically, the ionic liquid anions 300, once applied to the metal surface 302 of the MEMS device based on charge and chemical interactions, may associate with ionic liquid cations 304 located on the metal surface. The ionic liquid anions 300 tethered to the metal surface 302 attract the ionic liquid cations 304. The surface adsorption and long alkyl chains typically present in the ionic liquid cations 304 may result in the formation of a layer of stacked ions with non-polar functionality. This reduces direct contact between moving parts and reduces surface energy, and there is a reduction in friction and wear, particularly in the boundary lubrication wear regime.

In one or more examples, the film formed by association of the ionic salt with the one or more surfaces covers at least 50% of the exposed area of the one or more surfaces, alternatively from about 50% to about 90% or, alternatively, from about 75% to about 95%. A greater coverage area over a surface results in greater non-wettability of that surface. In one or more examples, the film is a monolayer film having a thickness of from about 1 nm to about 50 nm, alternatively from about 1 nm to about 40 nm or, alternatively, from about 1 nm to about 25 nm.

In other examples, the ionic liquid is in contact with the one or more surfaces a plurality of times under conditions suitable for the formation of a multilayer film. In such examples, the multilayer film may have from 2 to 5 layers with each layer having a thickness ranging from about 1 nm to about 50 nm. In such examples, the first film layer, designated $F_m$, may be in contact with the one or more surfaces while additional film layers ($F_{m+1}$, $F_{m+2}$, etc.) may be disposed on the previous film layer. A film thus formed on the one or more surfaces may be characterized by the formation of stacked ions with non-polar, alkyl functionality. This film, designated IL-FILM, may reduce both direct contact between the moving parts of the MEMS device and the surface energy of the MEMS device. Additionally, the IL-FILM consisting of stacked ions with non-polar, alkyl functionality may display a more rigid structure due to stacking of the non-polar (hydrophobic) portions of the molecules resulting in increased structural integrity that promotes the film having sufficient rigidity to allow it to remain in a position to provide lubrication of the one or more surfaces.

In an example, the IL-FILM is characterized by a contact angle of equal to or greater than about 80°, alternatively from about 80° to about 150° or, alternatively, from about 80° to about 120°, where the contact angle is determined in accordance with ASTM (formerly known as American Society for Testing and Materials) D5946. The contact angle, θ (theta), is a quantitative measure of wetting of a solid by a liquid. The contact angle is geometrically defined as the angle formed by a liquid at the three-phase boundary where a liquid, gas and solid intersect. When the contact angle is high, the liquid does not spread significantly on the solid surface, indicating that the surface is more hydrophobic (water-repellent). Because greater hydrophobicity generally results in improved lubrication, a higher contact angle results in improved lubrication.

In an example, the IL-FILM is characterized by a coefficient of friction of less than about 0.1 to about 0.099, alternatively from about 0.05 to about 0.095 or, alternatively, from about 0.025 to about 0.090. The coefficient of friction (COF) is a unitless number that represents the resistance to sliding of two surfaces in contact with each other. A lower COF indicates a lower friction force and thus improved lubrication.

In an example, an IL-FILM having a plurality of layers is characterized by an ability to self-heal when the structural integrity of the IL-FILM is compromised. For example, a multilayer IL-FILM having a first layer $F_{m1}$ in contact with the one or more surfaces may experience some loss of structural integrity. The loss of structural integrity may be due to, for example, removal of some portion of the film over time. Advantageously, areas having some portion of the first layer $F_{m1}$ may have the lubrication provided by the presence of the IL-FILM maintained due to the presence of the adjacent film layers $F_{m2}$, $F_{m3}$, etc.

In one or more examples, the IL-FILM disclosed herein mitigates the challenges resulting from stiction. For example, IL-FILMs of the present disclosure may display a resistance to the temperatures associated with the processes used for formation of the MEMS device. For example, IL-FILMs may maintain their functional integrity at temperatures ranging from about 25° C. to about 300° C., alternatively from about 25° C. to about 250° C. or, alternatively, from about 25° C. to about 200° C. As used herein, "maintain functional integrity" refers to the ability of the IL-FILM to continue to provide lubrication after exposure to these temperatures as evidenced by a COF value within the ranges disclosed herein. In alternative examples, the MEMS device may be resistant to corrosion as determined by non-wettability and contact angle within ranges disclosed.

Figure 4:
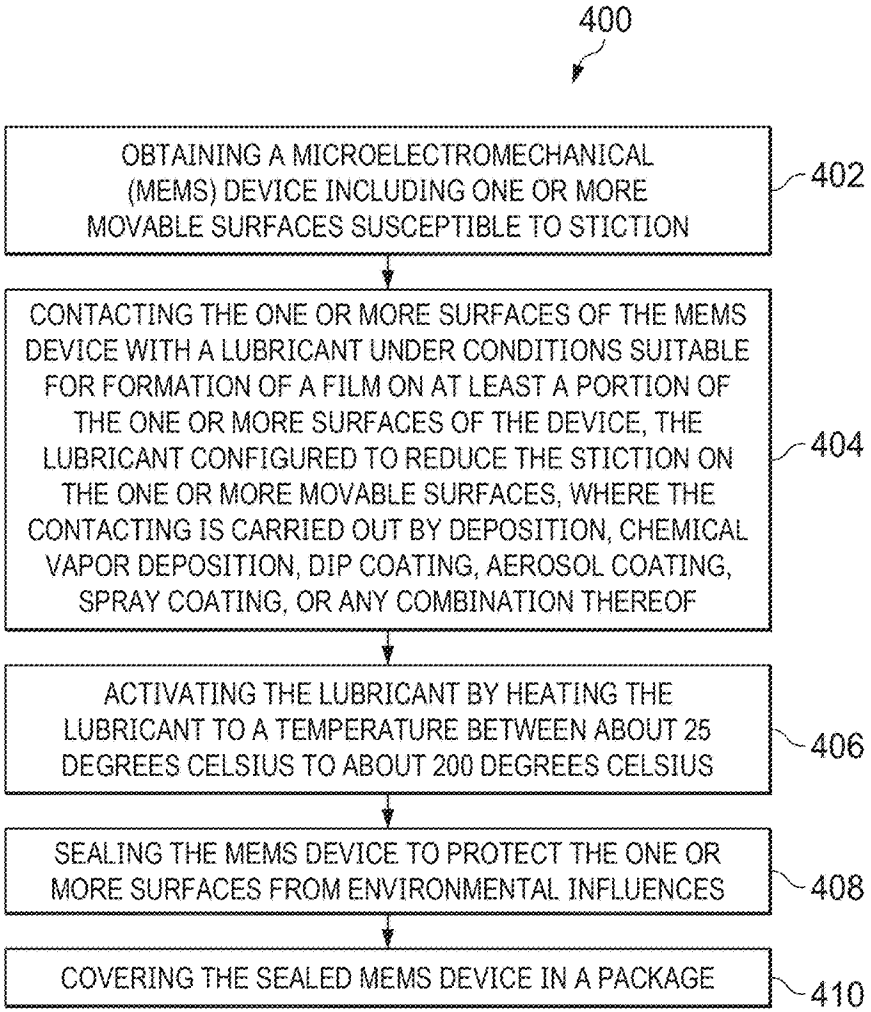
FIG. 4 is a flow diagram of a method for manufacturing a MEMS device lubricated with anti-stiction ionic liquids, in accordance with various examples.

FIG. 4 is a flow diagram of a method 400 for manufacturing a MEMS device lubricated with anti-stiction ionic liquids, in accordance with various examples. The method 400 may include obtaining a MEMS device including one or more movable surfaces susceptible to stiction (402). The MEMS device may include any suitable type of device, such as a DMD, accelerometer, gyroscope, pressure sensor, microphone, printhead, microvalve, optical switch, thermal actuator, micropump, magnetometer, etc. Obtaining a MEMS device may include manufacturing the MEMS device, purchasing the MEMS device, or any other acquisition of the MEMS device. In each MEMS device, different types of components may be susceptible to stiction. For example, in a DMD, mirrors and mirror-supporting structures may be susceptible to stiction, while in a gyroscope, a resonating element may be susceptible to stiction.

The method 400 may include contacting the one or more surfaces of the MEMS device with a lubricant (e.g., any of the chemical compounds described herein) under conditions suitable for formation of a film on at least a portion of the one or more surfaces of the device (404). The lubricant is configured to reduce the stiction on the one or more movable surfaces (404). The contacting may be performed by deposition, chemical vapor deposition, dip coating, aerosol coating, spray coating, or any combination thereof (404). (The MEMS device provided in step 402 is configured such that the one or more surfaces on which the lubricant is to be applied is accessible to the equipment that will subsequently be used in step 404 to apply the lubricant. Thus, for example, in the context of a DMD, the micromirror array of the DMD may not have been hermetically sealed prior to step 404.) In step 404, the lubricant may be applied at least to the one or more surfaces that are susceptible to stiction, and, depending on the application technique, to additional surface(s) of the MEMS device as well. In some examples, the lubricant may be applied indiscriminately to the MEMS device, including to the one or more surfaces susceptible to stiction.

The method 400 may include activating the lubricant by heating the lubricant to a temperature between about 25° C. to about 200° C. (406). Activating the lubricant by heating may result in the formation of a uniform reaction layer (film) between the ionic liquid and the metal surface that increases the lubricating properties of the film. Heating of the lubricant after application of the ionic liquid to the metal surface may result in an increased oxidation of metals near the surface. Conversion of the elemental metals at or near the surface to their cationic counterpart allows for an increased number of charged interactions between the metal surface and the ionic liquid anions where such interactions include chemisorption and/or physisorption.

The method 400 may include sealing the MEMS device to protect the one or more surfaces from environmental influences (408). For example, in the case of a DMD, a hermetic seal may be formed to protect the DMD micromirror array from environmental contaminants and moisture. This seal may be formed by bonding a cover glass or lid over the micromirror array using a hermetic sealing technique, such as glass frit sealing or solder sealing. The material used to seal (e.g., solder) forms a strong, impermeable seal when heated or cured. This hermetic seal may prevent moisture, dust, and other environmental contaminants from entering the device. Other types of seals are possible in a variety of MEMS applications. For example, while hermetic seals may be useful in DMDs, accelerometers, gyroscopes, and pressure sensors, non-hermetic seals may be useful in microphones (e.g., conformal and/or environmental coatings), microfluidic devices (e.g., adhesive or gasket seals), and bioMEMS devices (e.g., polymer encapsulation).

The method 400 may include covering the sealed MEMS device in a package (410). For example, a DMD device may be coupled to metal contacts (e.g., bond pads) in a ceramic substrate package, such as by wire bonding or bumping. Other types of MEMS devices, such as gyroscopes or accelerometers, may be included in ceramic packages, mold compound packages, or other suitable types of packages.

Figure 5:
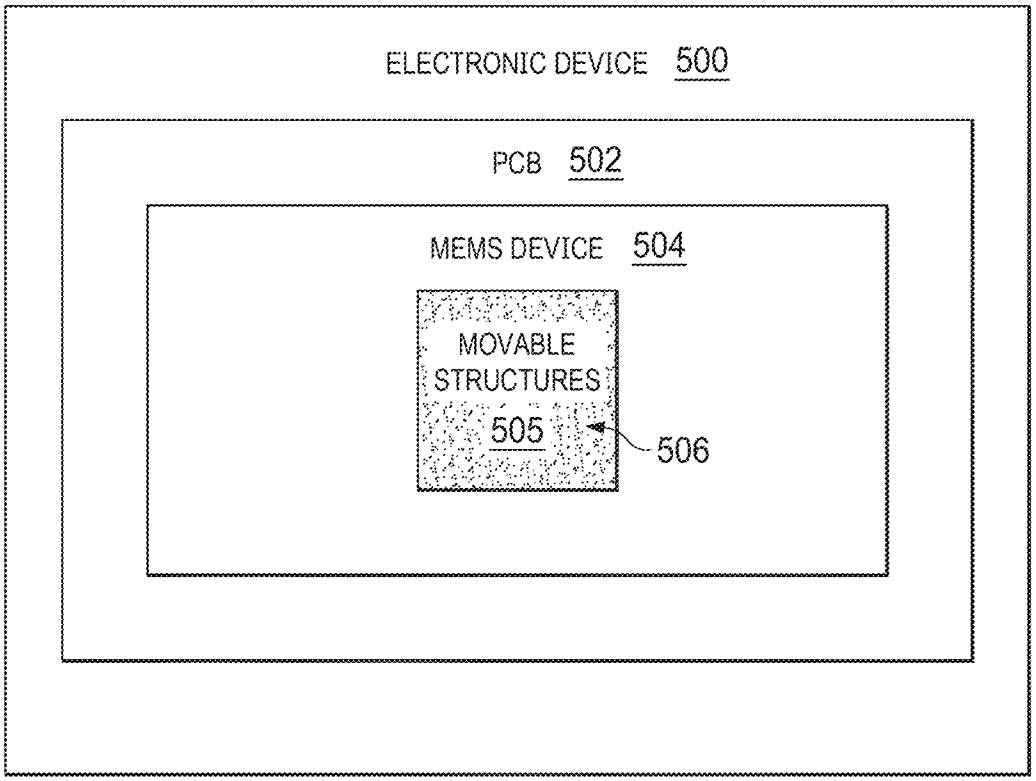
FIG. 5 is a block diagram of a MEMS device lubricated with an anti-stiction ionic liquid, in accordance with various examples.

FIG. 5 is a block diagram of a MEMS device lubricated with an anti-stiction ionic liquid, in accordance with various examples. The electronic device 500 may be, for example, an automobile, an aircraft, a watercraft, a spacecraft, a video game console, a smartphone, an entertainment device, an appliance, a laptop computer, a desktop computer, a tablet, a notebook, a projector, or any other suitable type of device or system. The electronic device 500 may optionally include a printed circuit board (PCB) 502 coupled to a MEMS device 504. The MEMS device 504 may be manufactured according to the method 400, described above. Examples of the MEMS device 504 include DMDs, accelerometers, gyroscopes, pressure sensors, microphones, printheads, microvalves, optical switches, thermal actuators, micropumps, magnetometers, etc. A lubricant 506 (e.g., any of the chemical compounds described herein) may cover one or more areas of the MEMS device 504, including one or more movable structures 505 susceptible to stiction. The lubricant 506 mitigates stiction on surfaces to which it is applied.

Figure 6A:
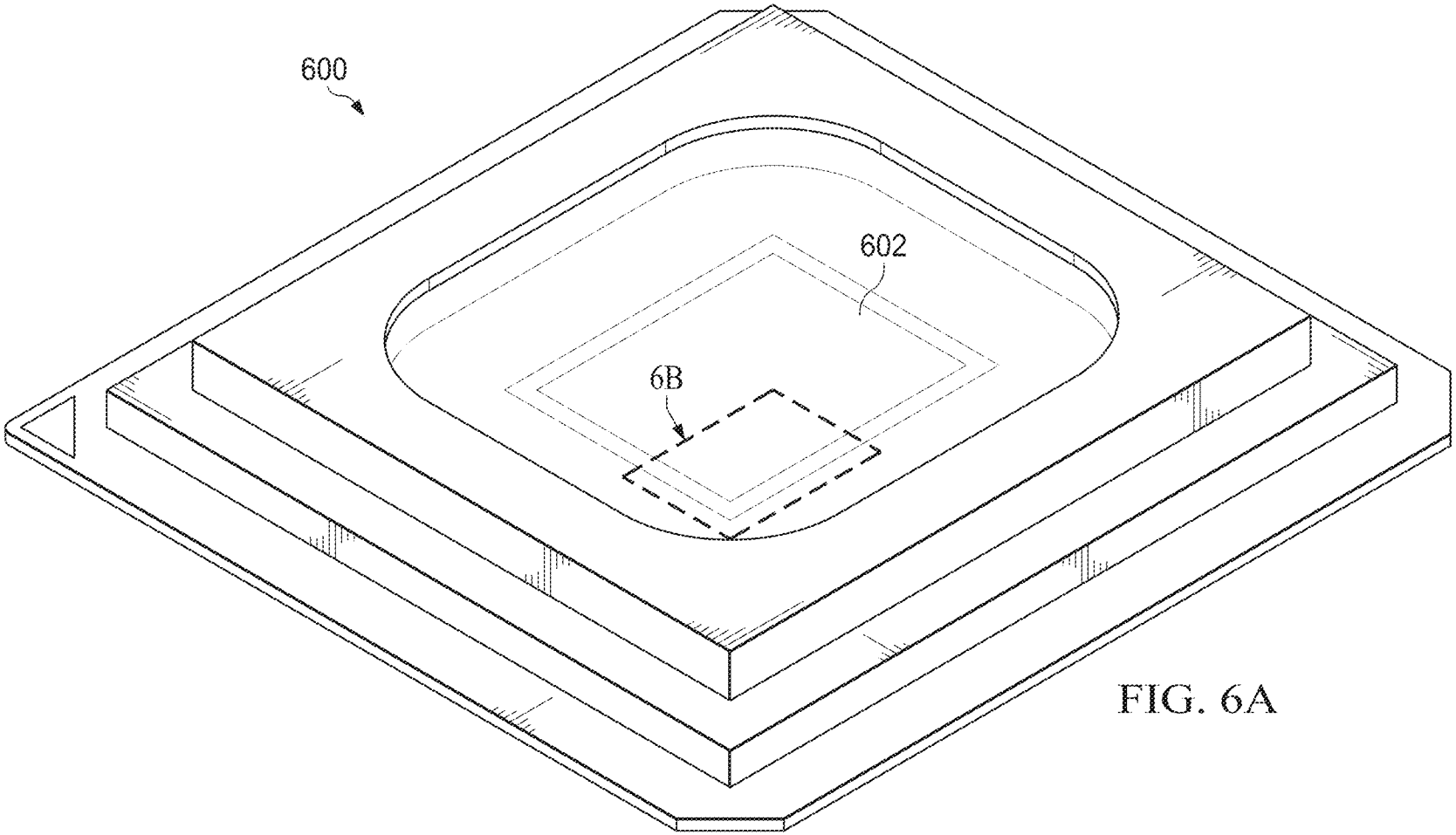
FIGS. 6A-6C are schematic diagrams of a digital micromirror device (DMD) lubricated with an anti-stiction ionic liquid, in accordance with various examples.
Figure 6B:
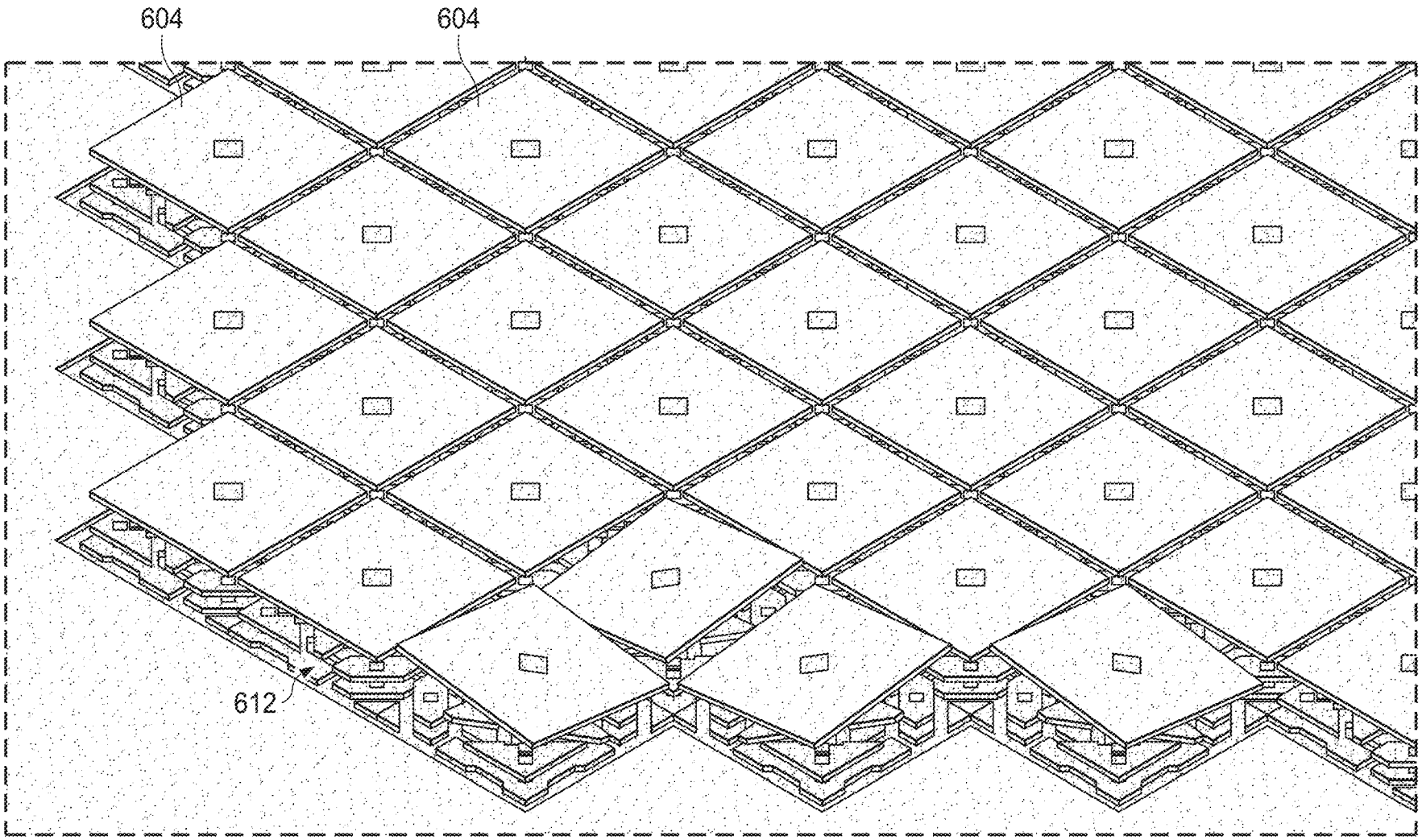
Figure 6C:
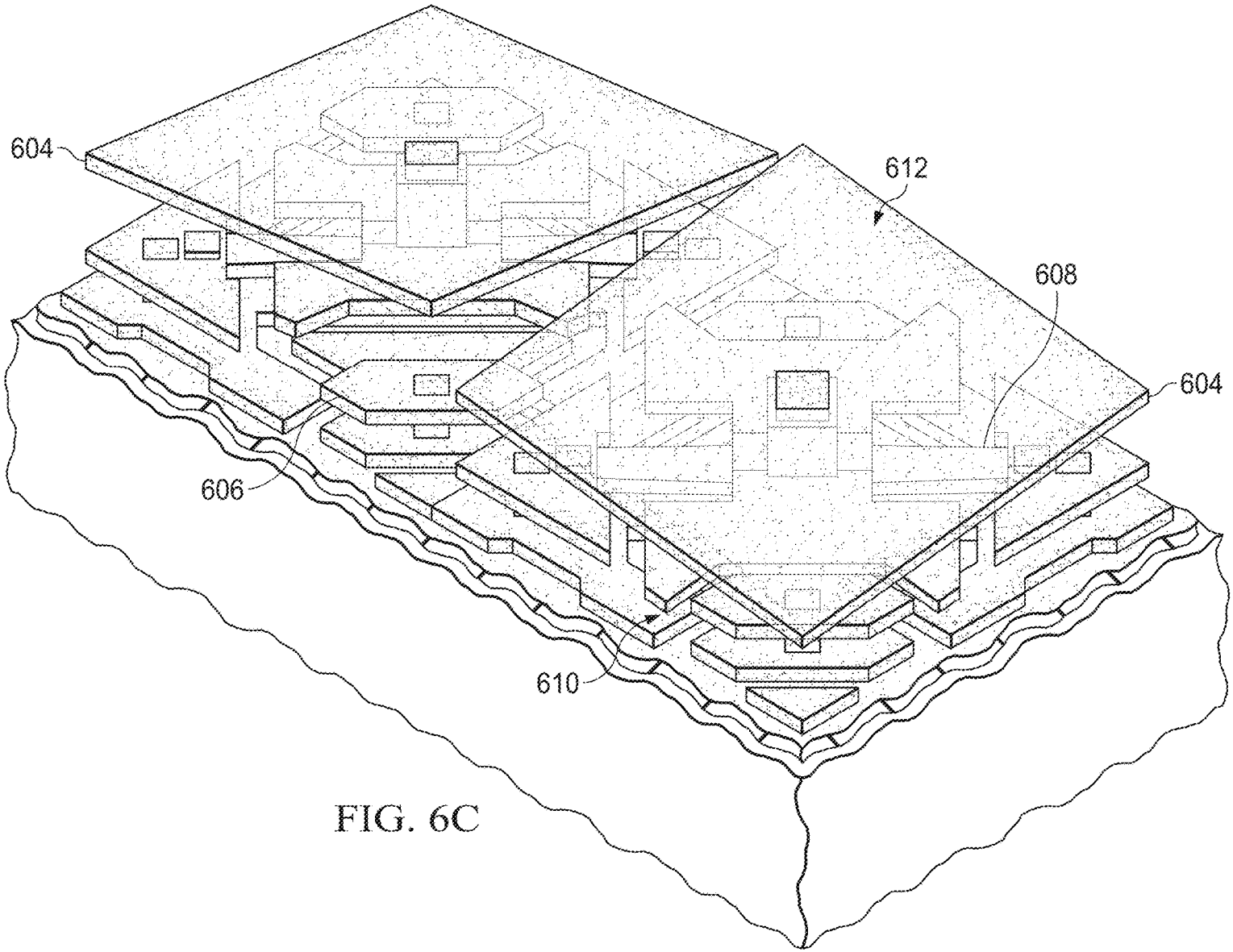

FIGS. 6A-6C are schematic diagrams of a digital micromirror device (DMD) lubricated with an anti-stiction ionic liquid, in accordance with various examples. More specifically, FIG. 6A depicts an example DMD device 600 including a micromirror array 602. The inset in FIG. 6B shows a close-up view of a portion of the micromirror array 602, which includes multiple mirrors 604. The mirrors 604 are configured to tilt in various directions, depending on the direction in which light is to be reflected, as shown in FIG. 6C. The micromirror array 602 may include various components under the mirrors 604 that facilitate movement of the mirrors 604 in response to specific electrical signals. For instance, such components may include electrodes 606, torsion hinges 608, and spring tips 610. The electrodes 606 generate electrostatic fields that cause the respective mirror 604 to tilt in one direction or another; the torsion hinges 608 provide mechanical support and help restore the respective mirror 604 to a neutral, non-tilted state after the electrostatic fields cease; and the spring tips 610 prevent contact between the respective mirror 604 and a respective electrode 606. Any of the components depicted in FIG. 6C may be susceptible to stiction, and thus a lubricant 612 (e.g., any of the chemical compounds described herein) is applied during manufacture of the DMD device 600 to mitigate stiction and its deleterious effects. The lubricant 612 mitigates stiction on surfaces to which it is applied.

Figure 7:
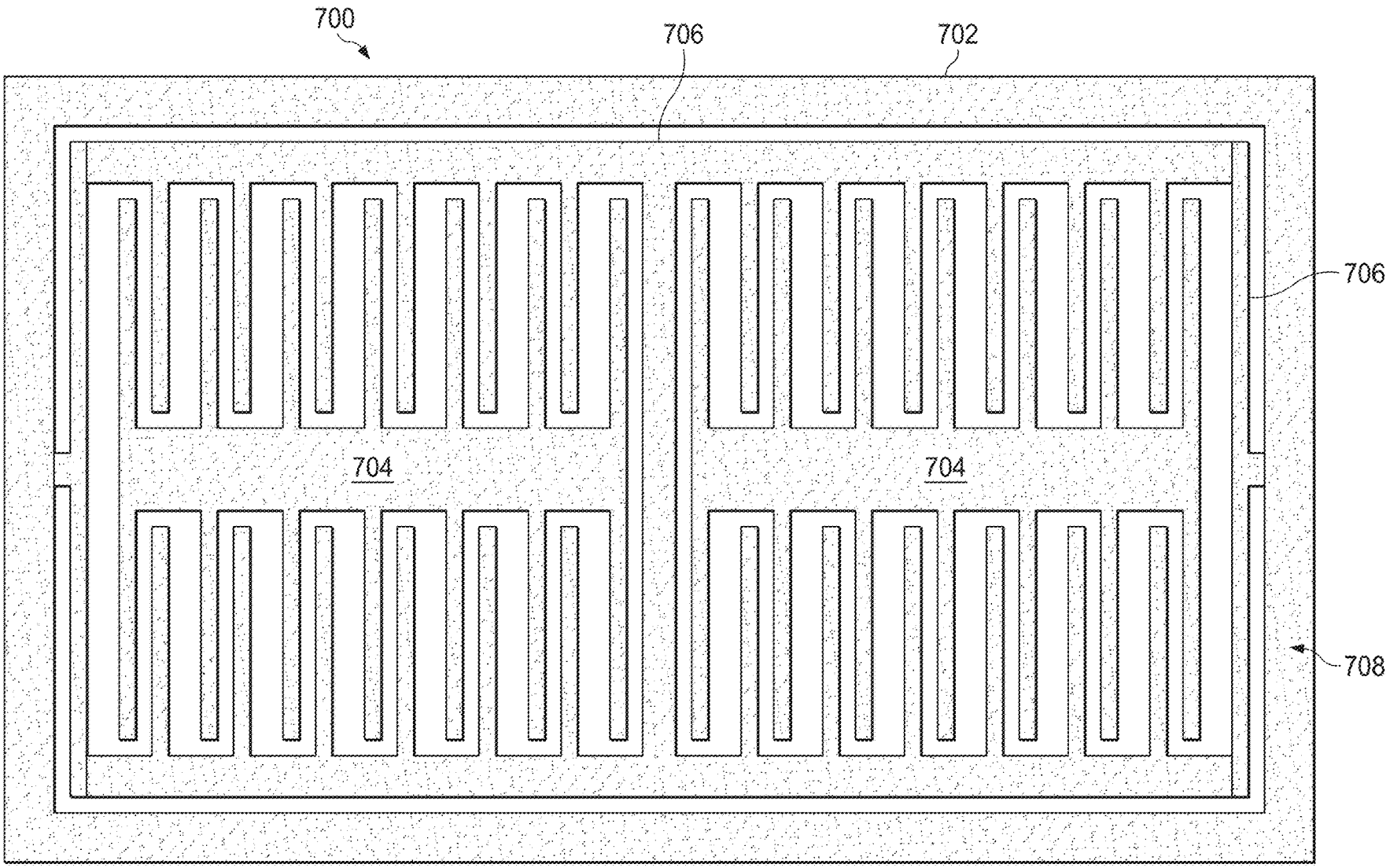
FIG. 7 is a schematic diagram of an accelerometer lubricated with an anti-stiction ionic liquid, in accordance with various examples.

FIG. 7 is a schematic diagram of an accelerometer lubricated with an anti-stiction ionic liquid, in accordance with various examples. Specifically, FIG. 7 depicts moving components of an example MEMS accelerometer 700. The MEMS accelerometer 700 includes a support frame 702, fixed electrodes 704, and a movable proof mass 706. Movement of the movable proof mass 706 relative to the fixed electrodes 704 responsive to acceleration causes capacitive changes that may be sensed by the fixed electrodes 704. As a movable component, the movable proof mass 706 is susceptible to stiction, particularly as the spring constant is decreased to achieve higher accelerometer sensitivity. A lubricant 708 (e.g., any of the chemical compounds described herein) covers various surfaces, including the movable proof mass 706, and mitigates stiction and the undesirable consequences resulting from stiction. The lubricant 708 mitigates stiction on surfaces to which it is applied.

The MEMS devices shown in FIGS. 6A-6C and 7 are merely illustrative. Any of the chemical compounds described herein may be useful to lubricate any type of MEMS device to mitigate stiction. Further, the scope of application for the chemical compounds described herein is not limited to MEMS devices. Rather, the chemical compounds described herein may be useful to lubricate any type of device with one or more moving components susceptible to stiction.

In this description, the term "couple" may cover connections, communications, or signal paths that enable a functional relationship consistent with this description. For example, if device A generates a signal to control device B to perform an action: (a) in a first example, device A is coupled to device B by direct connection; or (b) in a second example, device A is coupled to device B through intervening component C if intervening component C does not alter the functional relationship between device A and device B, such that device B is controlled by device A via the control signal generated by device A.

A device that is "configured to" perform a task or function may be configured at a time of manufacturing by a manufacturer to perform the function and/or may be configurable (or reconfigurable) by a user after manufacturing to perform the function and/or other additional or alternative functions. The configuring may be through a construction and/or physical arrangement of hardware components and interconnections of the device, for example.

In this description, unless otherwise stated, "about," "approximately" or "substantially" preceding a parameter means being within +/−10 percent of that parameter. Modifications are possible in the described examples, and other examples are possible within the scope of the claims.

Unit abbreviations include C for Celsius, cm for centimeters, mg for milligrams, and nm for nanometers.

What is claimed is:

1. A microelectromechanical systems (MEMS) device comprising:

a mirror configured to tilt in a first direction to contact a first spring tip at a first portion of a surface and tilt in a second direction to contact a second spring tip at a second portion of the surface, wherein the mirror comprises aluminum and the spring tip comprises aluminum; and a film on the first and second portions of the surface, in which the film is a result of an ionic fluid having been heated and having reacted with one or more chemical groups of the first and second portions.

2. The device of claim 1, wherein the film is a monolayer film having a thickness of from about 1 nm to less than about 50 nm.

3. The device of claim 2, wherein the film exhibits a contact angle of equal to or greater than 80 degrees as determined in accordance with ASTM D5946.

4. The device of claim 1, wherein the film is a multilayer film comprising a plurality of layers n, wherein n ranges from 2 to 5 and wherein each layer has a thickness of from about 1 nm to less than about 50 nm.

5. The device of claim 1, wherein the ionic liquid has a vapor pressure of from about $1\times10^{-12}$ torr to about $1\times10^{-2}$ torr.

6. The device of claim 1, wherein the ionic liquid has a boiling point of from about 200° C. to about 600° C.

7. The device of claim 1, wherein the ionic liquid comprises a cation characterized by a general formula $YR_n$, wherein Y is an onium ion; R is a substituted alkyl group, an unsubstituted alkyl group or a combination thereof; and n ranges from 1 to 6.

8. The device of claim 7, wherein the cation comprises an imidazolium ion, a phosphonium ion, an ammonium ion, a pyrrolidinium ion, or a combination thereof.

9. The device of claim 1, wherein the ionic liquid comprises an anion characterized by a general formula $QZ_n$, wherein Q is phosphorus, sulfur, or boron; Z is a halide, oxygen, alkoxy group, haloalkyl group or a combination thereof; and n ranges from 1 to 6.

10. The device of claim 9, wherein the anion comprises tetrafluoroborate, hexafluorophosphate, phosphate, perfluoroalkyl phosphate, bis(trifluoromethanesulfonyl)amide, or a combination thereof.

11. A method, comprising:

contacting first and second portions of one or more surfaces of a micromechanical systems (MEMS) device with an ionic liquid, wherein the ionic liquid comprises a cation characterized by a general formula $YR_n$, wherein Y is an onium ion and R is a substituted alkyl group, an unsubstituted alkyl group or a combination thereof and n ranges from 1 to 6, and wherein the ionic liquid comprises an anion characterized by a general formula $QZ_n$, wherein Q is phosphorus, sulfur, or boron and Z is a halide, oxygen, alkoxy group, haloalkyl or combination thereof and n ranges from 1 to 6;

activating the ionic liquid by heating the ionic liquid to a temperature between about 25° C. to about 200° C., wherein, in response to being activated, the ionic liquid is configured to react with one or more chemical groups of the first and second portions of the one or more surfaces to form a film on the first and second portions of the one or more surfaces; and sealing the MEMS device after activating the ionic liquid to form the film.

12. The method of claim 11, wherein the one or more chemical groups comprise hydroxyl groups or hydroxyl precursor groups.

13. The method of claim 11, wherein the contacting comprises deposition, chemical vapor deposition, dip coating, aerosol coating, spray coating, or any combination thereof.

14. The method of claim 11, wherein the film is a monolayer having a thickness of from about 1 nm to less than about 50 nm.

15. The method of claim 11, wherein the film is a multilayer film having n layers wherein n ranges from 2 to about 5 and each layer has a thickness of from about 1 nm to less than about 50 nm.

16. The method of claim 11, wherein the film exhibits a contact angle of equal to or greater than 80 degrees as determined in accordance with ASTM D5946.

17. A microelectromechanical device comprising:

a moveable element configured to contact a first portion of a surface and a second portion of the surface; and a film on the first and second portions of the surface, in which the film is a result of an ionic liquid on the first and second portions of the surface having been heated and having reacted with one or more chemical groups of the first and second portions, wherein the ionic liquid is characterized by a cation having any of Structures I or II, wherein R is an alkyl group.

I

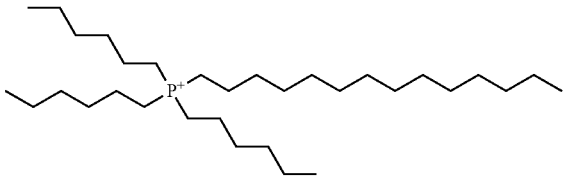

II

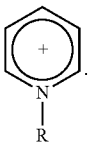

18. The device of claim 17, wherein the film has a thickness of from about 1 nm to less than about 50 nm.

19. The device of claim 18, wherein the film exhibits a contact angle of equal to or greater than 80 degrees as determined in accordance with ASTM D5946.

* * * * *